US011246409B2

(12) United States Patent
Felsenthal et al.

(10) Patent No.: US 11,246,409 B2
(45) Date of Patent: Feb. 15, 2022

(54) SHELF FOR SHOES AND OTHER ARTICLES

(71) Applicant: Whitmor, Inc., Southaven, MS (US)

(72) Inventors: Sandy Felsenthal, Memphis, TN (US); Gil Gaska, Germantown, TN (US)

(73) Assignee: Whitmor, Inc., Southaven, MS (US)

( * ) Notice: Subject to any disclaimer, the term of this patent is extended or adjusted under 35 U.S.C. 154(b) by 0 days.

(21) Appl. No.: 17/088,420

(22) Filed: Nov. 3, 2020

(65) Prior Publication Data

US 2021/0076818 A1 Mar. 18, 2021

Related U.S. Application Data

(63) Continuation-in-part of application No. 29/706,160, filed on Sep. 18, 2019.

(51) Int. Cl.

| | |
|---|---|
| ***A47B 61/04*** | (2006.01) |
| ***A47B 96/02*** | (2006.01) |
| ***A47B 47/06*** | (2006.01) |
| ***A47B 47/00*** | (2006.01) |
| ***A47B 43/04*** | (2006.01) |
| ***A47B 47/04*** | (2006.01) |
| ***A47F 5/10*** | (2006.01) |

(52) U.S. Cl.

CPC ..... *A47B 61/04* (2013.01); *A47B 43/04* (2013.01); *A47B 47/0083* (2013.01); *A47B 47/045* (2013.01); *A47B 47/06* (2013.01); *A47B 96/02* (2013.01); *A47F 5/108* (2013.01)

(58) Field of Classification Search

CPC ..... A47B 61/04; A47B 96/02; A47B 61/00; A47B 61/003; A47B 55/06; A47B 47/06; A47B 47/021; A47B 47/03; A47B 47/02; A47B 47/045; A47B 47/0083; A47B 47/0058; A47B 43/04; A47B 43/003; A47B 43/02; A47F 7/08; A47F 5/0043; A47F 2005/165; A47F 5/108

USPC ..... 211/37, 34, 38, 36, 204, 206, 134

See application file for complete search history.

(56) References Cited

U.S. PATENT DOCUMENTS

| | | | | | |
|---|---|---|---|---|---|
| 904,755 | A | * | 11/1908 | Carter | A47B 61/04 211/36 |
| 1,231,713 | A | * | 7/1917 | Cummings | A47F 7/08 211/38 |
| 1,724,386 | A | * | 8/1929 | Weston | A47F 5/13 211/85 |
| D190,587 | S | * | 6/1961 | Magers | D6/675.4 |
| 3,149,727 | A | * | 9/1964 | Trust | A47F 7/144 211/186 |
| 4,270,816 | A | * | 6/1981 | Erickson | A47B 47/06 135/97 |
| 5,172,816 | A | * | 12/1992 | Kline | A47B 87/0207 211/194 |
| 5,617,959 | A | * | 4/1997 | Klein | A47B 61/04 211/34 |

(Continued)

*Primary Examiner* — Jennifer E. Novosad

(74) *Attorney, Agent, or Firm* — Stites & Harbison PLLC; Richard S. Myers, Jr.

(57) ABSTRACT

A storage unit comprising a frame portion and a liner portion. The frame portion is comprised of vertical supports that engage and support the liner portion. The liner portion included a backer portion. The liner portion also comprises angled shelving components that extend from the front and back of the liner portion, with the shelving components attaching to the backer portion and the frame.

12 Claims, 6 Drawing Sheets

(56) References Cited

U.S. PATENT DOCUMENTS 5,622,415 A * 4/1997 Felsenthal ..... A47B 43/006 108/110
5,636,751 A * 6/1997 Frank ..... A47B 61/04 211/163
5,718,490 A * 2/1998 Liao ..... A47B 43/04 135/157
5,957,310 A * 9/1999 Mitchell ..... A47B 43/00 211/186
6,032,965 A * 3/2000 Sabounjian ..... A47B 47/06 280/47.35
6,126,021 A * 10/2000 Wilhite ..... A47B 43/04 211/113
6,305,764 B1 * 10/2001 Kortman ..... A47B 43/00 108/162
7,549,654 B2 * 6/2009 Anderson ..... B62B 3/006 211/85.24
7,681,728 B2 * 3/2010 Sabounjian ..... A47B 43/003 206/278.1
7,832,571 B2 * 11/2010 Felsenthal ..... A47B 47/027 211/134
9,187,111 B2 * 11/2015 Lai ..... A47B 57/404
9,211,002 B2 * 12/2015 Lo ..... A47B 47/06
9,572,426 B1 * 2/2017 Nauseda ..... B65G 1/02
9,756,939 B1 * 9/2017 Ruiz ..... A47B 43/04
10,750,858 B1 * 8/2020 Barre ..... A47B 47/0058
D904,808 S * 12/2020 Felsenthal ..... D6/675.4
11,013,319 B2 * 5/2021 Felsenthal ..... A47B 96/1441
2002/0162815 A1 * 11/2002 Wang ..... A47B 43/003 211/194
2004/0217076 A1 * 11/2004 Gallagher ..... A47F 7/14 211/186
2006/0081490 A1 * 4/2006 Bradford ..... B65D 71/0096 206/386
2009/0026161 A1 * 1/2009 Scriba ..... A47F 5/0018 211/144
2009/0184117 A1 * 7/2009 Wang ..... D06F 95/004 220/9.2
2011/0253656 A1 * 10/2011 Vermeer ..... A47F 5/137 211/85.8
2014/0353270 A1 * 12/2014 Murphy ..... A47B 87/0207 211/188
2015/0014265 A1 * 1/2015 Zhu ..... A47B 87/0276 211/201
2017/0238700 A1 * 8/2017 Davis ..... B65D 19/44
2017/0251808 A1 * 9/2017 Ruiz ..... A47B 55/00
2021/0076818 A1 * 3/2021 Felsenthal ..... A47B 61/04

* cited by examiner

SHELF FOR SHOES AND OTHER ARTICLES

PRIOR APPLICATIONS

This application is a continuation-in-part of U.S. patent application Ser. No. 29/706,160, filed Sep. 18, 2019, the contents of which are incorporated herein by reference.

FIELD OF THE INVENTION

The present invention relates to a storage unit, and in particular a storage unit that is easy to assemble, lightweight, compact, and portable.

BACKGROUND OF THE INVENTION

Storage shelves and units are generally known in the art, as are storage shelves for shoes and the like. However, many currently known designs commonly fail to adequately secure the shoes or other items intended to be stored in the rack, resulting in such shoes or other items falling from the rack. This problem is especially persistent with portable storage racks, where the movement of the unit causes the shoes and other items to shift and potentially fall. This can be especially problematic when shoes and other items of different dimensions are stored on the same rack or shelf. Accordingly, a need exists for a portable shoe storage rack capable of retaining shoes in the rack and preventing shoes from falling out of the front, back or sides of each shelf.

The present invention meets this need.

SUMMARY OF THE INVENTION

The present invention is directed to a storage rack that is easy to assemble, lightweight, compact, and portable. It can include a frame portion and a liner portion, and can include a plurality of storage shelves.

The frame portion can include a pair of vertically-orientated upside down U-shaped supports and a plurality of horizontal cross supports spaced along the height of the vertical supports, and connecting the U-shaped supports. The vertical supports can additionally include an upper support and an lower support that provides additional stability to the frame portion and to the liner portion.

The liner portion can include a shelf backer component configured for placement within the frame and a plurality of shelving components generally corresponding to the horizontal cross supports of the frame. Each shelving component can have one end fixed to the backer component and another end configured for securement to one of the horizontal cross supports of the frame. In addition, each shelving component can be secured to the backer component at a height slightly below the height of a corresponding cross support of the frame so that shelving component is suspended with a slight angled orientation when the frame and liner portions are connected together. The backer component may have shelves attaching to both the front surface and the back surface of the backer component.

Collectively, the frame portion and the liner portion form two sets of angled shelves along the height of the storage unit. The backer component provides and the angle of the shelving components help prevent shoes or other items from falling from the storage unit. The shelving components of the liner portion can also extend across the entire space between the horizontal cross supports of the frame and the backer component in order to prevent the shoes or other items stored in the storage unit from falling between the components of the frame.

Thus, one embodiment of the present invention is a storage unit that comprises a frame portion, said frame portion comprising: a left support, said left support having a rear support and a front support that is generally parallel to the left support, a lower cross bar that is attached to and joins the rear support and the front support, and a top support that joins the front and rear support; a right vertical support, said left support having a rear support and a front support that is generally parallel to the left support, a lower cross bar that is attached to and joins the rear support and the front support, and a top support that joins the front and rear support; an upper, generally horizontal cross support attached to and connecting the left top support and the right top support; a lower generally horizontal cross support attached to and connecting the left lower cross bar and the right lower cross bar; a plurality of front shelf supports attached to and joining the left front support and the right front support; a plurality of rear shelf supports attached to and joining the left rear support and the right rear support; a liner portion configured for attachment to said frame portion, said liner portion comprising: a backer component, said backer component configured for attachment to said upper cross support and said lower cross support; at least one front shelving component connected to said backer component and sized to extend between the backer component and a front shelf support, wherein said front shelving component includes a fixed end secured to the backer component and a free end opposite said fixed end, said free end having a receiving means for receiving at least one front shelf support; and at least one back shelving component connected to said backer component and sized to extend between the backer component and a rear shelf support, wherein said back shelving component includes a fixed end secured to the backer component and a free end opposite said fixed end, said free end having a receiving means for receiving at least one rear shelf support.

In another embodiment of the invention, the left support and right support are generally vertical and with the top supports generally form an upside down U.

In another embodiment of the invention, frame is metallic and tubular.

In another embodiment of the invention, the frame portion is multiple joined hollow tubular pieces that form the unitary frame portion.

In another embodiment of the invention, the backer component attaches to the upper cross support by a sleeve that forms a sheath over at least a portion of the upper cross support.

In another embodiment of the invention, the backer component attaches to the lower cross support by a sleeve that forms a sheath over at least a portion of the lower cross support.

In another embodiment of the invention, the angled orientation of said at least one shelving component is sloped toward said backer component.

In another embodiment of the invention, the fixed end of each at least one shelving component is secured to said backer component at a first height of said storage unit, and said at least one generally horizontal shelf support is a second height of said storage unit, and said first height is at an elevation less than an elevation of said second height.

In another embodiment of the invention, the receiving means for receiving the shelf support is a sewn loop formed in the shelf that wraps around the shelf support. In yet another embodiment of the invention, the loop is a sheath that wraps over most of the length of the shelf support.

In another embodiment of the invention, the liner portion is constructed from a fabric material. In yet another embodiment of the invention, the liner portion is a mesh material.

Other aspects and advantages of the present invention will be apparent from the following detailed description of the preferred embodiments and the accompanying drawings figures.

DESCRIPTION OF THE SEVERAL VIEWS OF THE DRAWINGS

In the accompanying drawings, which form a part of the specification and is to be read in conjunction therewith in which like reference numerals are used to indicate like or similar parts in the various views.

DETAILED DESCRIPTION OF THE INVENTION

Figure 1:
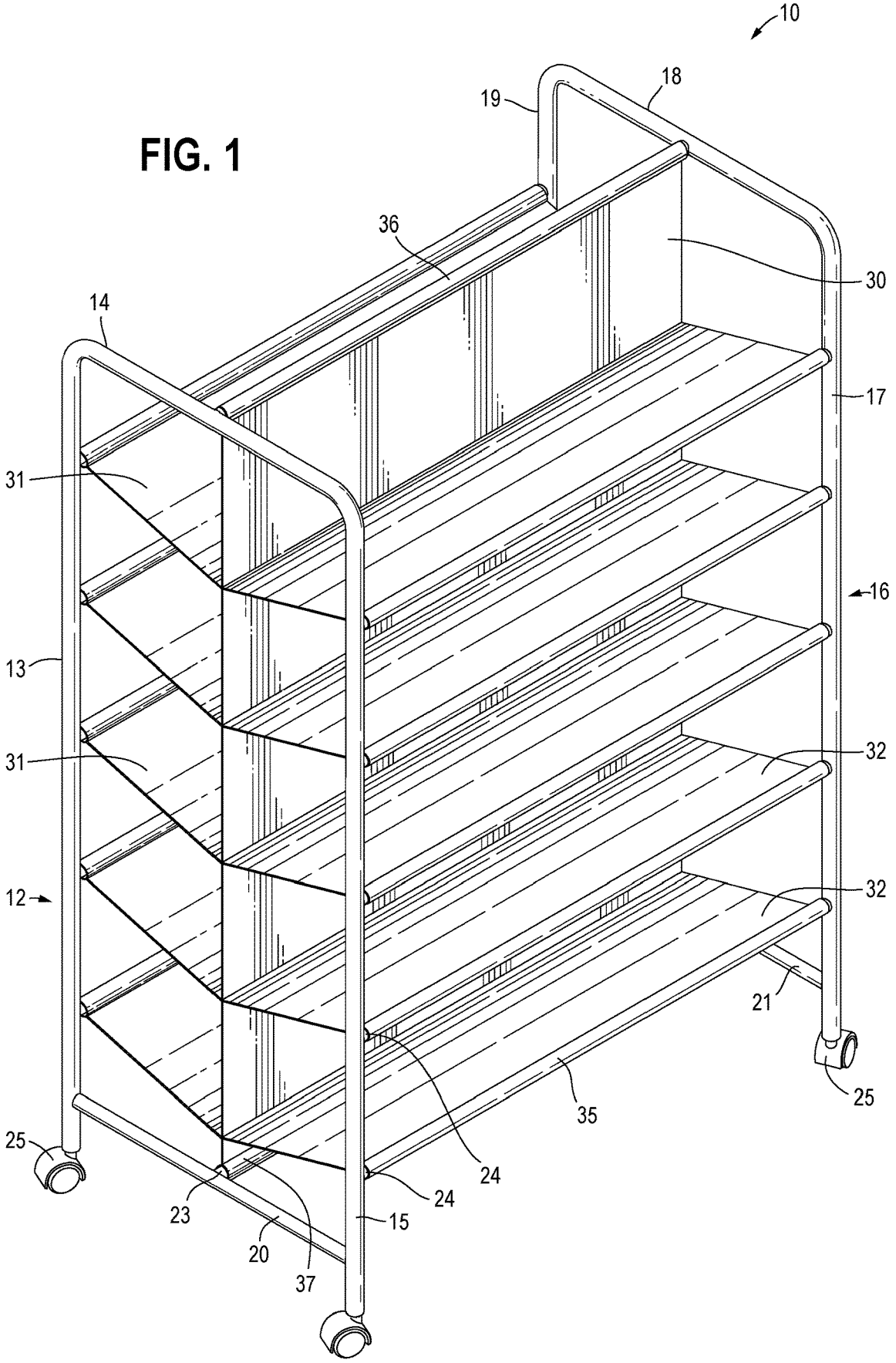
FIG. 1 is a front perspective view of an embodiment of the storage unit of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

The present invention is directed generally to a storage unit 10. An embodiment of the storage unit of the present invention is shown in FIG. 1. Embodiments of the present are compact and efficient, lightweight, easy to ship and assemble, sturdy, and portable. While the embodiments shown are certainly suitable for storing shoes, the shelves can be easily customized to store a variety of articles. Thus, it is recognized that storage unit 10 can be designed and configured to hold and store any number of different items depending on the particular embodiment of the present invention.

Figure 2:
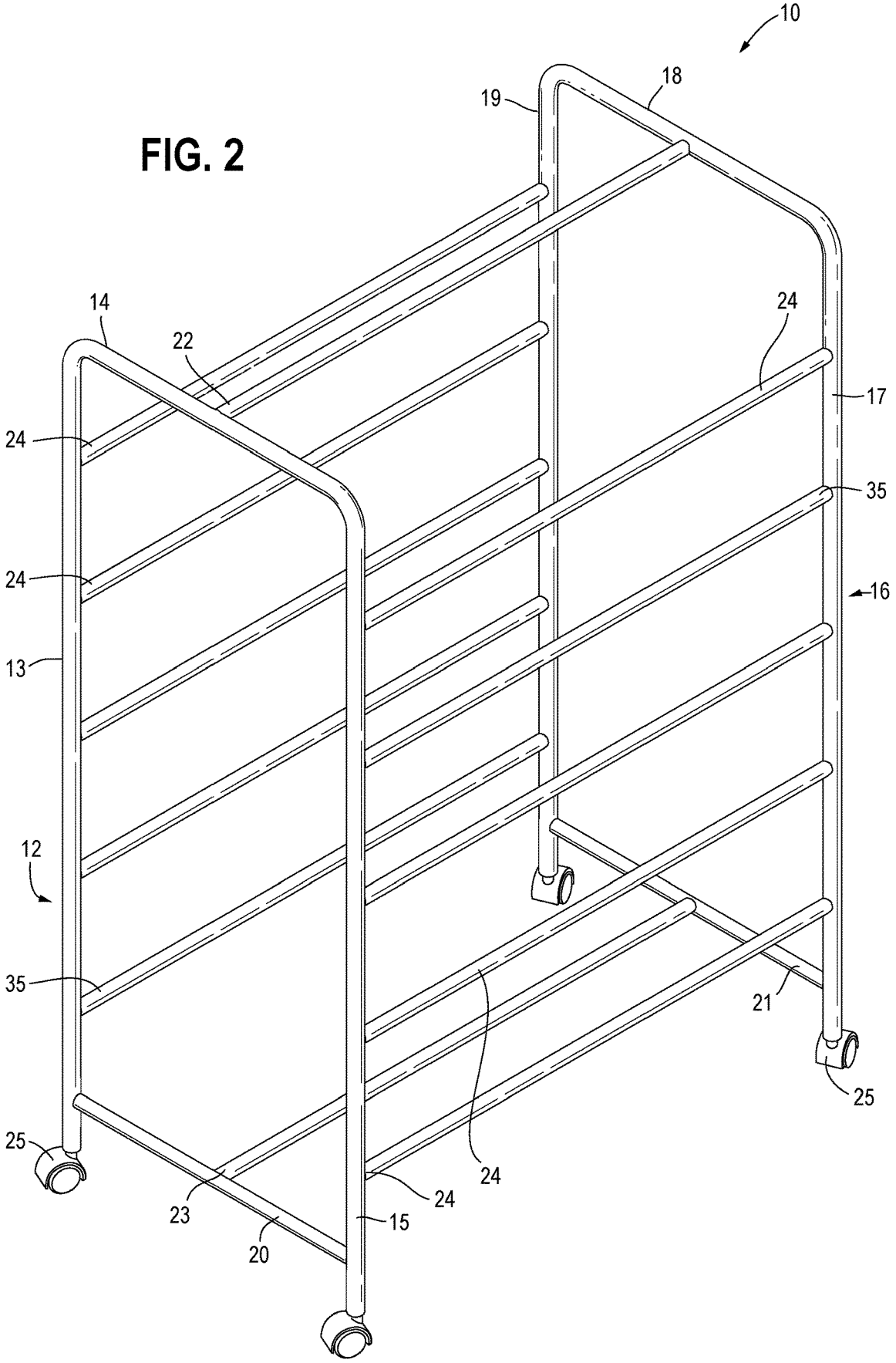
FIG. 2 is a perspective view of the frame portion of the storage unit of the present invention.
Figure 3:
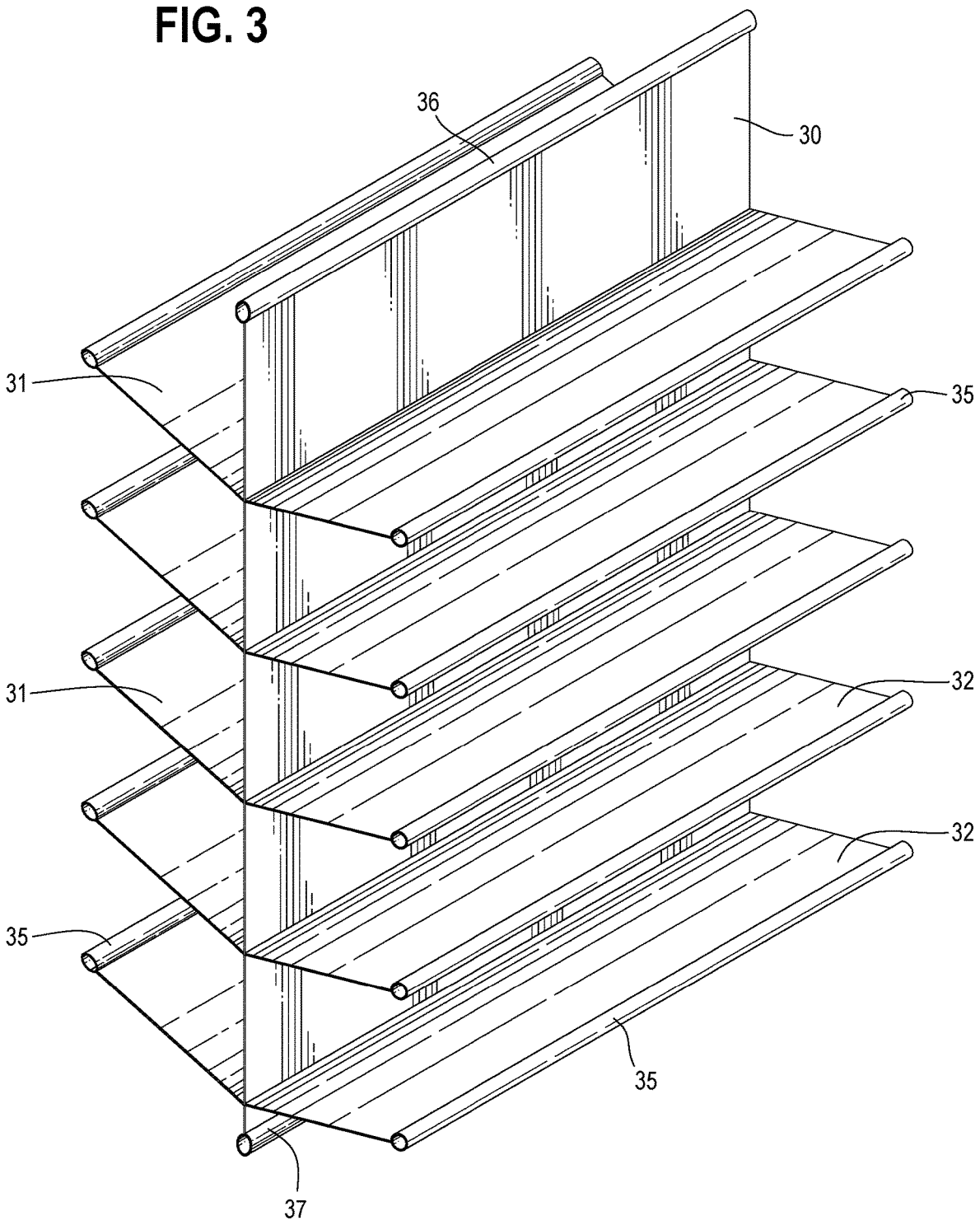
FIG. 3 is perspective view of the liner portion of the storage unit of the present invention.

As shown in FIG. 1, storage unit 10 can comprise a frame portion and a liner portion. The frame portion is shown separately in FIG. 2. The liner portion is shown separately in FIG. 3. Depending on the specific embodiment of the present invention, frame portion and liner portion can be integrally configured as a single component or frame portion and liner portion can be constructed separately and configured to be connected together. FIG. 2 illustrates the frame portion apart from liner portion, and FIG. 3 illustrates the liner portion apart from frame portion. FIG. 1, and FIGS. 4-6 illustrate frame portion and liner portion together forming storage unit 10.

As also shown in FIG. 1, frame portion and liner portion can collectively form a plurality of shelves 31, 32 along the height of storage unit 10. As shown, shelves 31, 32 can have a slightly angled orientation as described in greater detail below. However, in alternative embodiments of the present invention, shelves 31, 32 can have a generally flat orientation or an angled orientation of any desired degree.

The frame portion shown in FIGS. 1 and 2 comprises a left support 12 and a right support 16. The left support 12 has rear 13, top 14, and front 15 supports. The rear 13 and front 15 supports are generally vertical and general parallel to one another. The top support 14 joins the rear 13 and the front 15 supports to form, generally, and upside down U. These supports can be separate, assembled pieces, or one unitary structure. The left support 14 has at least one horizontal support bar 20 that joins and supports the rear 13 and front 15 supports. The left and right supports can be "open" as shown in the drawings, or closed with a panel, mesh, etc.

Likewise, the right support 16 has rear 19, top 18, and front 17 supports. The rear 19 and front 17 supports are generally vertical and general parallel to one another. The top support 18 joins the rear 19 and the front 17 supports to form, generally, and upside down U. These supports can also be separate, assembled pieces, or one unitary structure. The right support 16 also has at least one horizontal support bar 21 that joins and supports the rear 19 and front 17 supports.

The left support 12 and right support 16 are joined by the shelf supports 24. The shelf supports 24 either join the left front frame 15 with the right front frame 17, or the shelf supports 24 join the left rear support 12 with the right rear support 19. If the unit 10 comprises five shelves, the unit will have five shelf supports 24. The unit 10 can be configured for any number of shelves/rows of shelves (front and back of the unit). For example, the unit 10 can be configured to have 3, 4, or 5 rows of shelves, and up to 10 or more rows. FIG. 1 shows an embodiment with 5 rows of shelves, ten shelves in all.

The left support 12 and right support 16 are also joined by an upper cross bar 22 and a lower cross bar 23. Typically, the upper cross bar 22 joins the top 14 of the left support and the top 18 of the right support. The lower cross bar 23 typically joins the left horizontal support 20 and the right horizontal support 21. The right support 16 also has a lower cross bar 21 that joins and supports the rear 19 and the front 17 vertical supports.

The frame portion can be constructed from any suitable material, including metal or plastic, and can be in the form of solid or hollow tubes, bars or rods. Preferably, the frame portion is constructed from metal tubes, for ease of assembly and shipping. Connecting means for the sections can be any suitable type of connection, including screws, bolts, openings, slots, clips, fasteners and the like. For example, the left support can comprise a vertical rear element 13 that is attached to a top portion 14, which is in turn connected to the vertical front support 15.

The frame portion can also include wheels 25 or casters. To provide portability to the unit. The casters 25 are located at the lower ends of the left support 12 and the right support 16.

The liner portion is shown in FIGS. 1 and 3. In FIG. 1, the liner portion is shown attached to the frame portion. In FIG. 3, the liner portion is shown apart from the frame portion.

The liner portion can be constructed from any suitable flexible or semi-rigid material, including fabric, plastic, mesh or other suitable material. Liner portion can include a backer component 30 and a plurality of shelving components 31, 32 spaced along the height of backer component 42. The backer component 30 can be sized and shaped to generally conform to the shape of frame portion and can be configured for placement on the upper cross bar 22, the lower cross bar 23, and the shelf supports that join the left frame 12 and the right frame 16. The backer can be a solid material, flexible fabric, mesh, etc.

Although numerous attachment methods for the liner and the frame portion are contemplated, sleeves are shown in the figures. In other embodiments, straps that do not substantially cover the supports can be used as the attachment methods.

As shown in FIG. 1 and others, depending on the specific embodiment of the present invention, the frame portion and the liner portion can be integrally configured as a single component with sleeves that engage the support rods. For example, the backer 30 has a top sleeve 36 and a bottom sleeve 37. The top sleeve 36 engages the upper cross bar 22 and the bottom sleeve 37 engages the lower cross bar 23. In embodiments of the present invention, the sleeves can be configured as loops sized and shaped to allow end supports to be inserted therethrough prior to connection of the supports to the left frame 12 and the right frame 16. For example, loops can have a cross-section generally conforming to the cross-section of the corresponding support. Such loops can be constructed by sewing, adhesive or molding or by placement of selectively detachable fasteners, such as hook-and-loop strips, or other suitable means in order to construct the sleeve. In alternative embodiments (not shown), the attachment means can be configured as clips, rings, clasps, clamps, individually-spaced loops, fasteners or any other suitable means.

The shelving components 31, 32 can be positioned along the height of backer component 30. Each shelving component can include a fixed end that can be connected to backer component 30 and a free end that can be configured for securement to one of the plurality of horizontal cross supports 24 of frame portion. The fixed end can be connected or secured to backer component 30 by sewing, adhesive, hook-and-loop fastener strips or other suitable means. The free end can include a loop, slot or other suitable receiving means 35 for securing the free end to a horizontal cross support 24. According to the embodiment shown in the figures, receiving means are constructed as sewn sleeves 35 and configured for receiving horizontal cross support 24 before horizontal cross support 24 is connected to the left frame 12 and the right frame 16. The cross-section of the sleeves 35 can be generally similar or slightly larger than the cross-section of horizontal cross supports 24. In alternative embodiments (not shown), the receiving means can be configured as any other suitable means for attaching free end to horizontal cross support 24 in a manner similar to the upper or top sleeve 36 and the lower or bottom sleeve 37 described above.

As shown in the figures, the backing component 30 attaches to shelves on both sides. Thus, the front shelves 32 have a fixed end that attaches to the front of the backing 30. At the same time, the rear shelves 31 have a fixed end that attaches to the opposite side of the backing 30. With this arrangement, the unit 10 forms rows of shelves. As stated above, it is contemplated that unit 10 can be configured to have 3, 4, or 5 rows of shelves, and any number of rows up to 10 or more.

Figure 5:
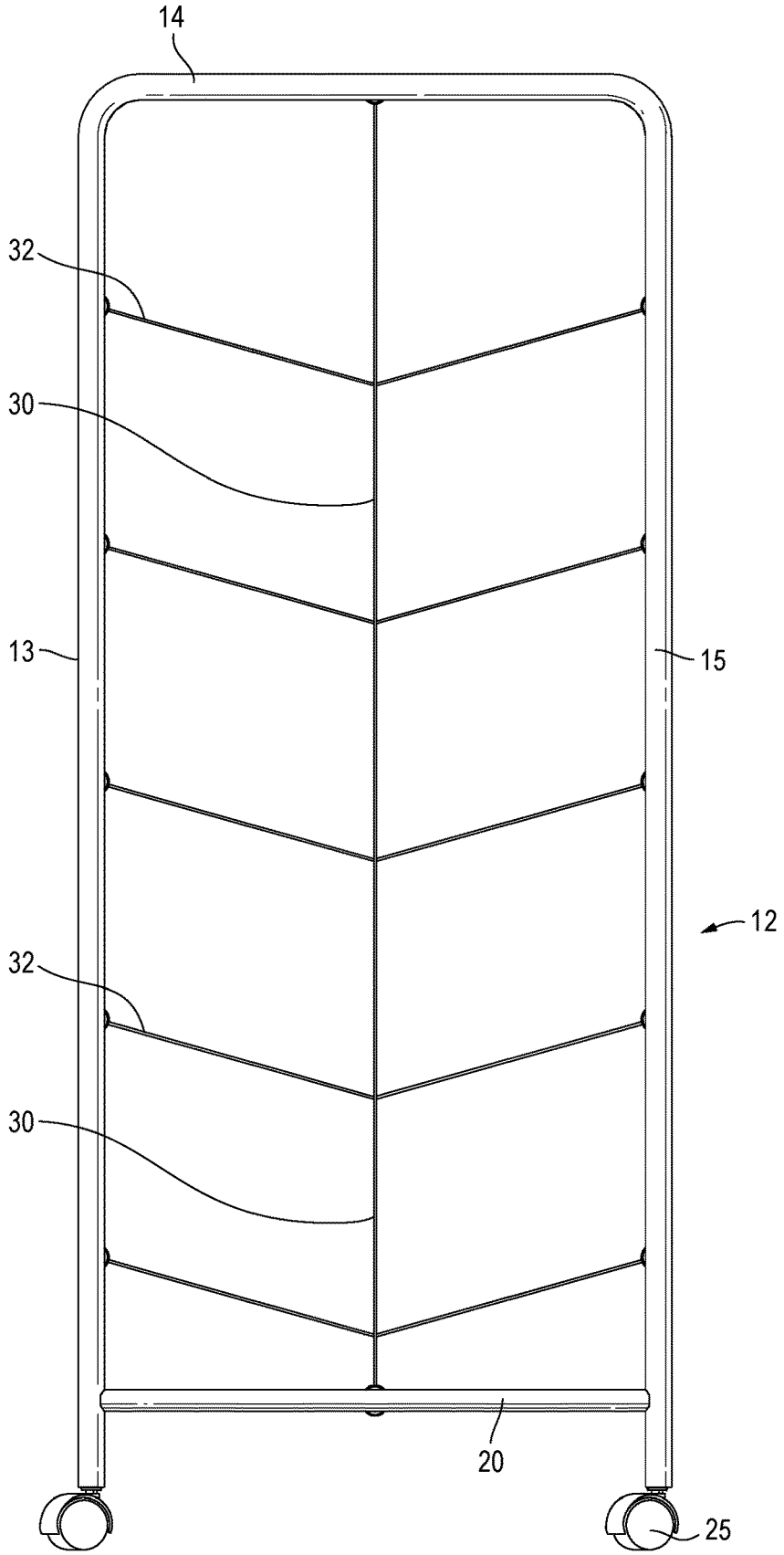
FIG. 5 is a side elevation view of the embodiment of the storage unit shown in FIG. 1.

As especially shown in FIGS. 3 and 5, the rear shelving components 31 and the front shelving components 32, 31 can be configured to have an angled orientation when liner portion is connected to frame portion. The angled orientation can be created by selective positioning of fixed end of each shelving component 31, 32 along the height of backer component 42. Each fixed end of each shelving component 31, 32 can be fixed or secured to backer component 30 at an elevation slightly below the elevation of the corresponding horizontal cross support 24 when frame portion and liner portion are connected together. This differential-elevation configuration between fixed end and free end/sleeve end relative to horizontal cross supports 24 of frame portion and backer component 30 of liner portion can create the angled orientation of shelving components 31, 32.

Figure 4:
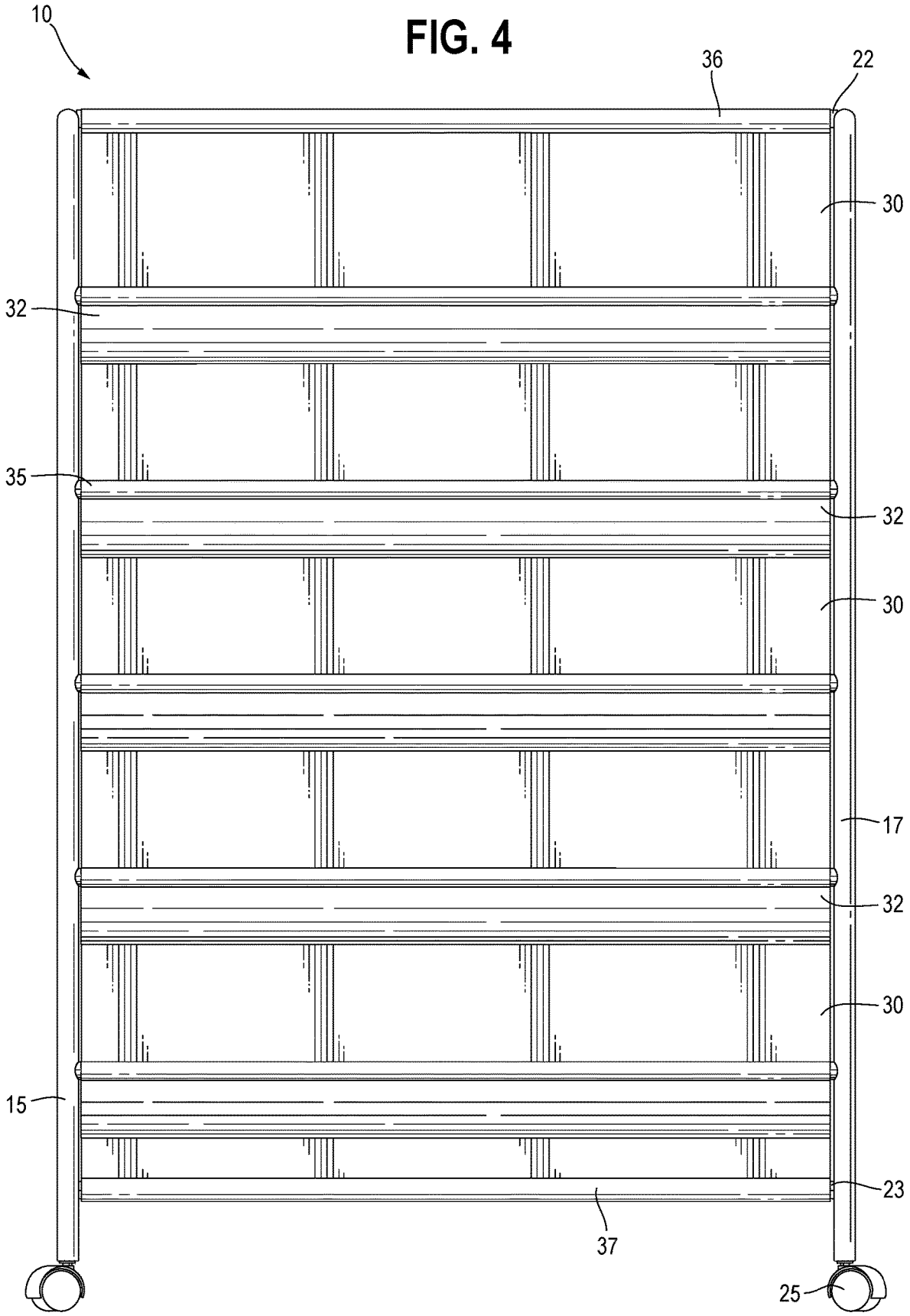
FIG. 4 is a front elevation view of the embodiment of the storage unit shown in FIG. 1.

FIG. 4 shows a front elevation view of the embodiment of the storage unit 10 shown in FIG. 1. The left front support 15 and the right front support are shown. They are attached together by the shelf supports and the lower cross bar 23. The unit 10 is resting on casters 25. The upper cross bar 22 is shown, but in this view it is primarily behind the top sleeve 35 of the liner portion. Below the top sleeve 35 is the backing, which is also attached to the lower cross bar 23 by a sleeve 37. The downward angled front shelves 32 are shown.

FIG. 5 shows a side view of the left support 12. Specifically, the rear frame 13, top frame 14 and the front frame 15 are shown. Attached thereto is the liner portion of the unit. From the side view, the backer 30 is shown in the middle of the frame. Attached thereto are the downward angled shelves 32.

Figure 6:
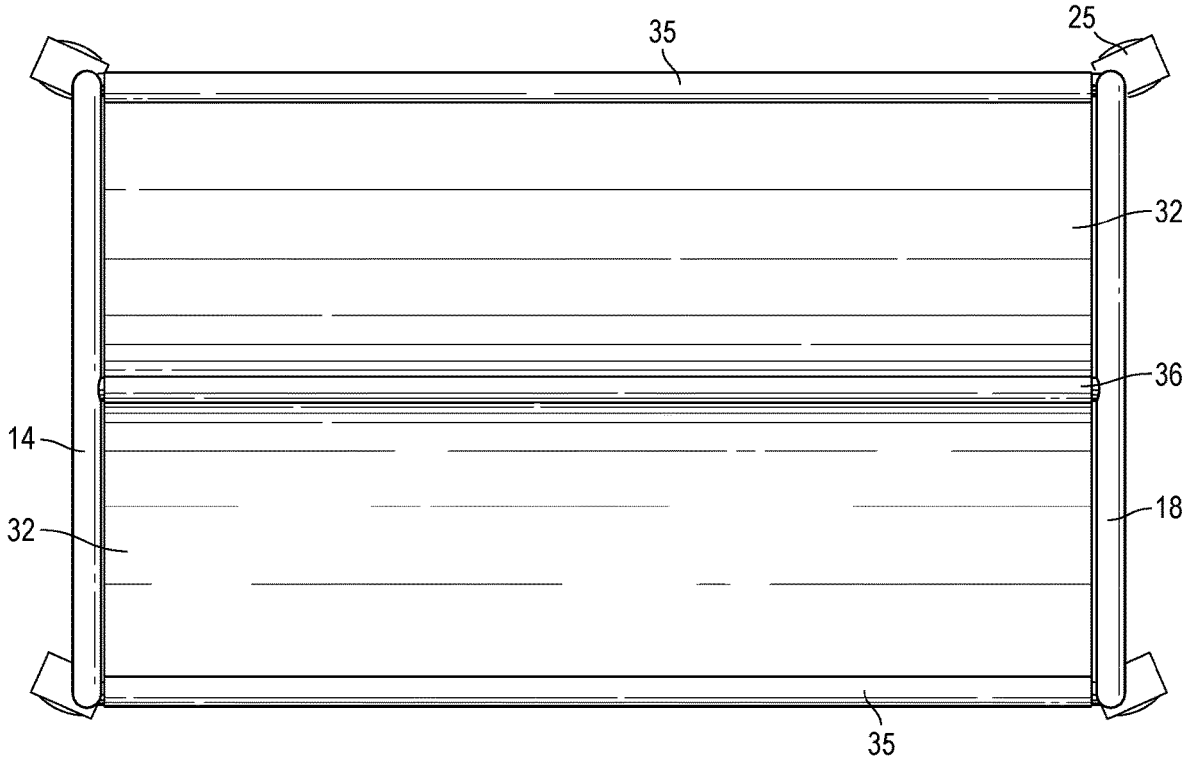
FIG. 6 is a top plan view of the embodiment of the storage unit shown in FIG. 1.

FIG. 6 shows a top view of an embodiment of the present invention. From this angle, another view of the left top support 14 and the right top support 18 is shown. The top of the attached shelf 32 is shown, as is the sleeve 35 attaching the shelf to the support.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required." Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

We claim:

1. A storage unit, comprising:

a frame portion, said frame portion comprising:

a left support, said left support having a rear support and a front support that is generally parallel to the rear support, a lower cross bar that is attached to and joins the rear support and the front support, and a top support that joins the front and rear support;

a right support, said right support having a rear support and a front support that is generally parallel to the rear support, a lower cross bar that is attached to and joins the rear support and the front support, and a top support that joins the front and rear support;

an upper generally horizontal cross support attached to and connecting the left top support and the right top support;

a lower generally horizontal cross support attached to and connecting the left lower cross bar and the right lower cross bar;

a plurality of front shelf supports attached to and joining the left front support and the right front support;

a plurality of rear shelf supports attached to and joining the left rear support and the right rear support;

a liner portion configured for attachment to said frame portion, said liner portion comprising:

a backer component, said backer component configured for attachment to said upper cross support and said lower cross support;

at least one front shelving component connected to said backer component and sized to extend between the backer component and a respective one of said plurality of front shelf supports, wherein said front shelving component includes a fixed end secured to the backer component and a free end opposite said fixed end, said free end having a receiving means for receiving at least one of said front shelf supports; and at least one back shelving component connected to said backer component and sized to extend between the backer component and a respective one of said plurality of rear shelf supports, wherein said back shelving component includes a fixed end secured to the backer component and a free end opposite said fixed end, said free end having a receiving means for receiving at least one of said rear shelf supports.

2. The storage unit of claim 1, wherein the left support and right support are generally vertical and with the top supports generally form an upside down U.

3. The storage unit of claim 1, wherein the frame portion is metallic and tubular.

4. The storage unit of claim 1, wherein the elements of said frame portion are multiple hollow tubular pieces that attach together to form a one-piece frame portion.

5. The storage unit of claim 1, wherein the backer component attaches to the upper cross support by a sleeve that forms a sheath over at least a portion of the upper cross support.

6. The storage unit of claim 1, wherein the backer component attaches to the lower cross support by a sleeve that forms a sheath over at least a portion of the lower cross support.

7. The storage unit of claim 1, wherein said fixed end of each at least one shelving component is secured to said backer component at a first height of said storage unit, and said at least one generally horizontal shelf support is a second height of said storage unit, and said first height is at an elevation less than an elevation of said second height.

8. The storage unit of claim 1, wherein the receiving means for receiving the front and rear shelf supports is a sewn loop formed in the shelf that wraps around the shelf support.

9. The storage unit of claim 8, wherein the loop is a sheath that wraps over most of the length of the front and rear shelf supports.

10. The storage unit of claim 1, wherein said liner portion is constructed from a fabric material.

11. The storage unit of claim 1, wherein the liner portion is a mesh material.

12. The storage unit of claim 1, wherein:

the fixed end of the at least one front shelving component secured to the backer component, and the free end received by the front support are angled so that the shelving component is angled toward the backer component; and the fixed end of the at least one back shelving component secured to the backer component, and the free end received by the front support are angled so that the shelving component is angled toward the backer component.

* * * * *